US012123261B1

(12) United States Patent
Clark et al.

(10) Patent No.: US 12,123,261 B1
(45) Date of Patent: Oct. 22, 2024

(54) DEPTH OF CUT CONTROL RESPONSIVE TO BOREHOLE TRAJECTORY

(71) Applicant: Halliburton Energy Services, Inc., Houston, TX (US)

(72) Inventors: Kevin Clark, Willis, TX (US); Kelley Plunkett, The Woodlands, TX (US); Curtis Lanning, Montgomery, TX (US); Douglas Caraway, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/130,728

(22) Filed: Apr. 4, 2023

(51) Int. Cl.
*E21B 10/567* (2006.01)
*E21B 10/43* (2006.01)

(52) U.S. Cl.
CPC ..... *E21B 10/567* (2013.01); *E21B 10/43* (2013.01)

(58) Field of Classification Search
CPC ..... E21B 10/567; E21B 10/43; E21B 10/62; E21B 10/42
See application file for complete search history.

(56) References Cited

U.S. PATENT DOCUMENTS

| | | | |
|---|---|---|---|
| 5,099,934 | A | 3/1992 | Barr |
| 7,836,975 | B2 | 11/2010 | Chen et al. |
| 7,849,939 | B2 | 12/2010 | Downton et al. |
| 7,971,662 | B2 | 7/2011 | Beuershausen |
| 8,061,455 | B2 | 11/2011 | Beuershausen |
| 8,087,479 | B2 | 1/2012 | Kulkarni et al. |
| 8,141,657 | B2 | 3/2012 | Hutton |
| 8,205,686 | B2 | 6/2012 | Beuershausen |
| 8,240,399 | B2 | 8/2012 | Kulkarni et al. |
| 9,080,399 | B2 | 7/2015 | Osterberg |
| 9,267,329 | B2 | 2/2016 | Bilen |
| 10,000,977 | B2 | 6/2018 | Jain et al. |
| 10,273,759 | B2 | 4/2019 | Ricks et al. |
| 10,358,873 | B2 | 7/2019 | Do et al. |
| 2009/0065262 | A1 | 3/2009 | Downton et al. |
| 2010/0071956 | A1 | 3/2010 | Beuershausen |
| 2011/0031025 | A1 | 2/2011 | Kulkarni et al. |
| 2011/0147089 | A1 | 6/2011 | Kulkarni et al. |
| 2012/0255788 | A1 | 10/2012 | Schwefe et al. |
| 2014/0174827 | A1 | 6/2014 | Schen et al. |
| 2014/0262511 | A1 | 9/2014 | Bilen |
| 2015/0152723 | A1 | 6/2015 | Hay |

(Continued)

FOREIGN PATENT DOCUMENTS

| | | |
|---|---|---|
| EP | 2401467 | 1/2012 |
| EP | 2859172 | 4/2015 |

(Continued)

*Primary Examiner* — Caroline N Butcher
(74) *Attorney, Agent, or Firm* — Michael Jenney; C. Tumey Law Group PLLC

(57) ABSTRACT

In general, in one aspect, embodiments relate to a drill bit, that includes a bit body, a plurality of cutters secured to the bit body, an axial reciprocating assembly, a lateral reciprocating assembly, and a sliding interface that includes a first contact surface and a second contact surface in direct sliding engagement with the first contact surface inside the bit body, such that an exposure of the first borehole engagement member varies with an exposure of the second borehole engagement member.

20 Claims, 5 Drawing Sheets

(56) References Cited

U.S. PATENT DOCUMENTS

| | | | | |
|---|---|---|---|---|
| 2015/0191979 | A1 | 7/2015 | Jain et al. | |
| 2017/0275951 | A1* | 9/2017 | Thomas | E21B 10/42 |
| 2021/0079733 | A1* | 3/2021 | Chen | E21B 10/62 |

FOREIGN PATENT DOCUMENTS

| | | |
|---|---|---|
| WO | 2013188206 | 12/2013 |
| WO | 2014165120 | 10/2014 |
| WO | 2016043755 | 3/2016 |

* cited by examiner

DEPTH OF CUT CONTROL RESPONSIVE TO BOREHOLE TRAJECTORY

BACKGROUND

Wells are constructed in subterranean formations in an effort to extract hydrocarbon fluids such as oil and gas. A borehole may be drilled with a rotary drill bit mounted at the lower end of a drill string. The drill string is assembled at the surface of a wellsite by progressively adding lengths of tubular drilling pipe to reach a desired depth. The drill bit is rotated by rotating the entire drill string from the surface of the well site and/or by rotating the drill bit with a downhole motor incorporated into a bottomhole assembly of the drill string. As the drill bit rotates against the formation, cutters on the drill bit disintegrate the formation in proximity to the drill bit. Drilling fluid is circulated through the drill string and the annulus between the drill string and the borehole to lubricate the drill bit and remove cuttings and other debris to surface.

Drilling can generate extreme forces, often under harsh conditions such as high temperatures, abrasive materials, and reactive fluids. Drilling generates friction and other forces that can result in prematurely worn or damaged drill bit components, such as the bit body and cutters. Numerous technologies have been developed in an effort to maximize bit life and mitigate damage. However, designing and optimizing a drill bit remains challenging, in part due to the wide range of bit loading that can occur, especially when directional drilling is employed.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
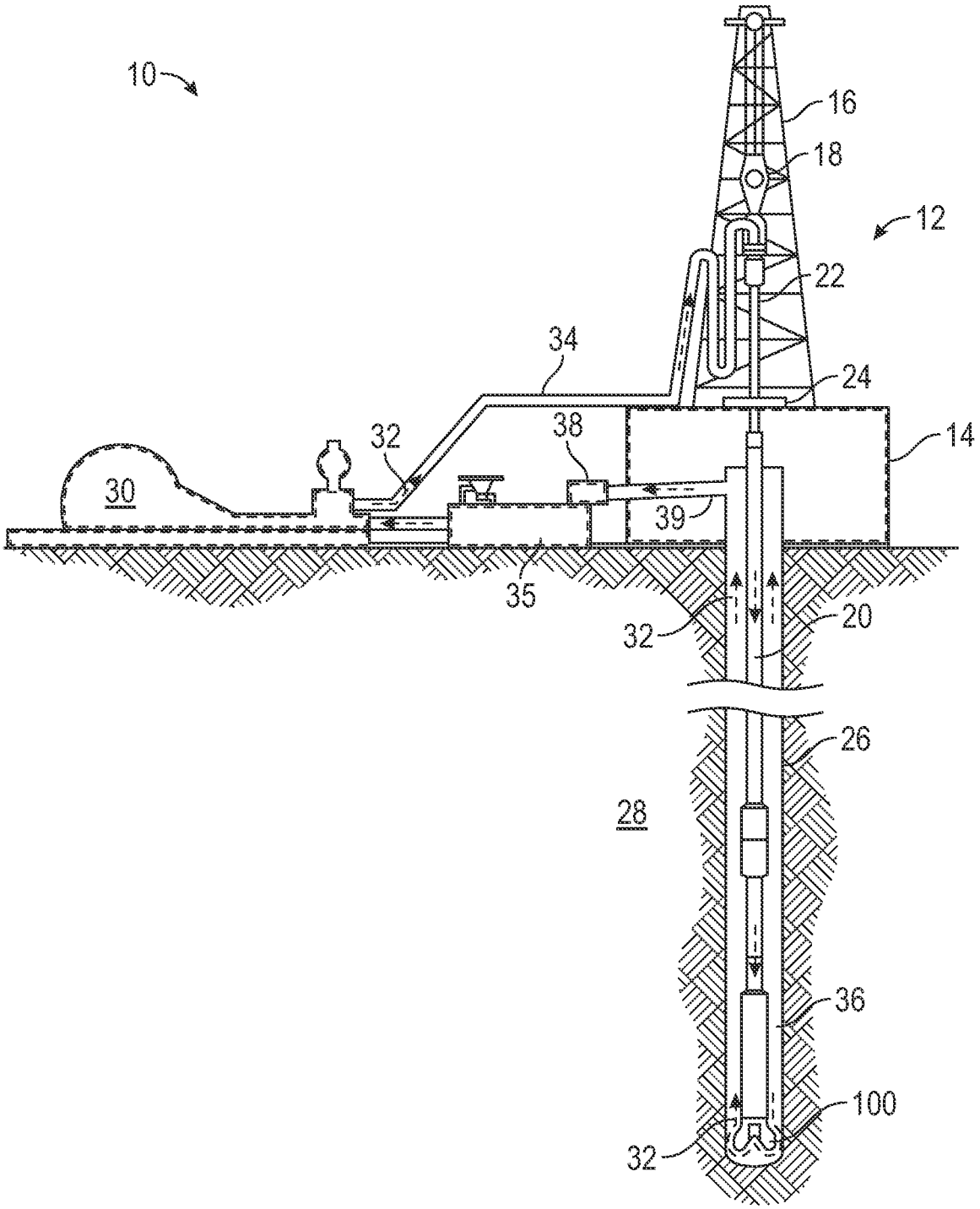
FIG. 1 is an elevation, partially cross-sectional view of a representative well site.

Various apparatus, systems, methods, and related constructs are presented to manage the wide range of dynamic loading on a drill bit that may occur while drilling. These are primarily discussed in the context of a fixed cutter drill bit having a plurality of fixed cutters secured at different locations to a bit body. However, one or more of the cutters may alternatively be rolling cutters secured at respective locations to the bit body. A drill bit has various borehole engagement members, such as cutters positioned to cut earthen formation along with depth of cut (DOCC) elements to limit a depth of cut of the respective cutters. As taught herein, some of the borehole engagement members are reciprocably secured to the bit body, allowing the borehole engagement members to extend or retract relative to the bit body during drilling, particularly in response to borehole trajectory. The borehole engagement members may be mounted on reciprocable carriers that are internally coupled to each other in direct sliding contact such that the exposure of one borehole engagement member varies in relation to the exposure of another borehole engagement member. The exposures vary in relation to one another as drill bit loading varies, and particularly as the borehole trajectory changes.

In one or more examples, the drill bit may include an axial reciprocating assembly and a lateral reciprocating assembly, each having a DOCC element. The axial reciprocating assembly is oriented to receive primarily axial forces while drilling, while the lateral reciprocating assembly is oriented to receive primarily lateral force components while drilling. The DOCC elements are mounted on carriers having a sliding interface inside the bit body, such that the exposure of one DOCC element varies inversely with the exposure of the other DOCC element. As the drill bit trajectory changes, the balance of axial and lateral forces changes such that the exposures of these DOCC elements varies in response. For example, when drilling a straight borehole section, when axial forces dominate, the axial DOCC element moves inwardly (exposure of the axial DOCC element decreases) while the lateral DOCC element moves outwardly (exposure of the lateral DOCC element increases). When drilling a deviated borehole section, and lateral forces increase relative to axial forces, the lateral DOCC element moves inwardly while the axial DOCC element moves outwardly. Thus, the depth of cut control varies dynamically in response to the borehole trajectory.

Several different variables are discussed to tune the dynamic response of the reciprocating assemblies. The dynamic response may include the relative forces required to move the axial and lateral DOCC elements, which affects how aggressive the drill bit is while drilling straight or curved borehole sections. The angles of the carriers relative to each other and relative to the bit axis may affect this dynamic response. The geometry of a sliding interface between axial and lateral carriers may also affect this dynamic response. The geometry of the carriers and of the DOCC elements are further variable affecting bit dynamics. Also, some embodiments include springs to bias the carriers axially (i.e., in a direction of their respective carrier axes), and whose spring properties (e.g., spring constant and travel) may affect dynamics. One or more dampers may also be included to dampen the axial movement of the carriers. Choice of coatings may also affect dynamic response. These and other aspects and features are explored in more detail in examples that follow.

FIG. 1 is an elevation, partially cross-sectional view of a representative well site 10 at which a borehole may be formed by drilling and other operations. While FIG. 1 generally depicts land-based drilling, the principles described herein are applicable to subsea drilling operations that employ floating or sea-based platforms and rigs, without departing from the scope of the disclosure. As illustrated, a drilling rig 10 may include a drilling platform 14 that supports a derrick 16 having a traveling block 18 for raising and lowering a drill string 20. The drill string 20 may include, but is not limited to, drill pipe and coiled tubing, as generally known to those skilled in the art. A kelly 22 supports the drill string 20 as it is lowered through a rotary table 24. A rotary drill bit 100 is attached to the distal end of the drill string 20 and may be rotated by via rotation of the drill string 20 from the well surface and/or a downhole motor. The drill bit 100 is used to form a borehole 26 in a subterranean formation 28. Other borehole forming tools may be included on the drill string for use in certain drilling operations, such as one or more hole opener and/or reamer to selectively widen a portion of the borehole 26, or a coring bit used to obtain and retrieve a sample of the formation for analysis.

The drill bit 100 may be a fixed-cutter drill bit having one or more fixed cutters, but may also include one or more shaped cutters or rolling cutters rotatable about respective cutter axes. A pump 30 (e.g., a mud pump) circulates drilling fluid (i.e., mud) 32 through a feed pipe 34 and to the kelly 22, which conveys the drilling fluid 32 downhole through the interior of the drill string 20 and through one or more orifices in the drill bit 100. The drilling fluid 32 is then circulated back to the surface via an annulus 36 defined between the drill string 20 and the walls of the borehole 26. At the surface, the recirculated or spent drilling fluid 32 exits the annulus 36 and may be conveyed to one or more fluid processing unit(s) 38 via an interconnecting a flow line 39. After passing through the fluid processing unit(s) 38, a cleaned drilling fluid 32 is deposited into a nearby retention pit 35 (i.e., a mud pit). While illustrated as being arranged at the outlet of the borehole 26 via the annulus 36, the fluid processing unit(s) 38 may be arranged at any other location in the drilling rig 10 to facilitate its proper function, without departing from the scope of the scope of the disclosure.

Figure 2:
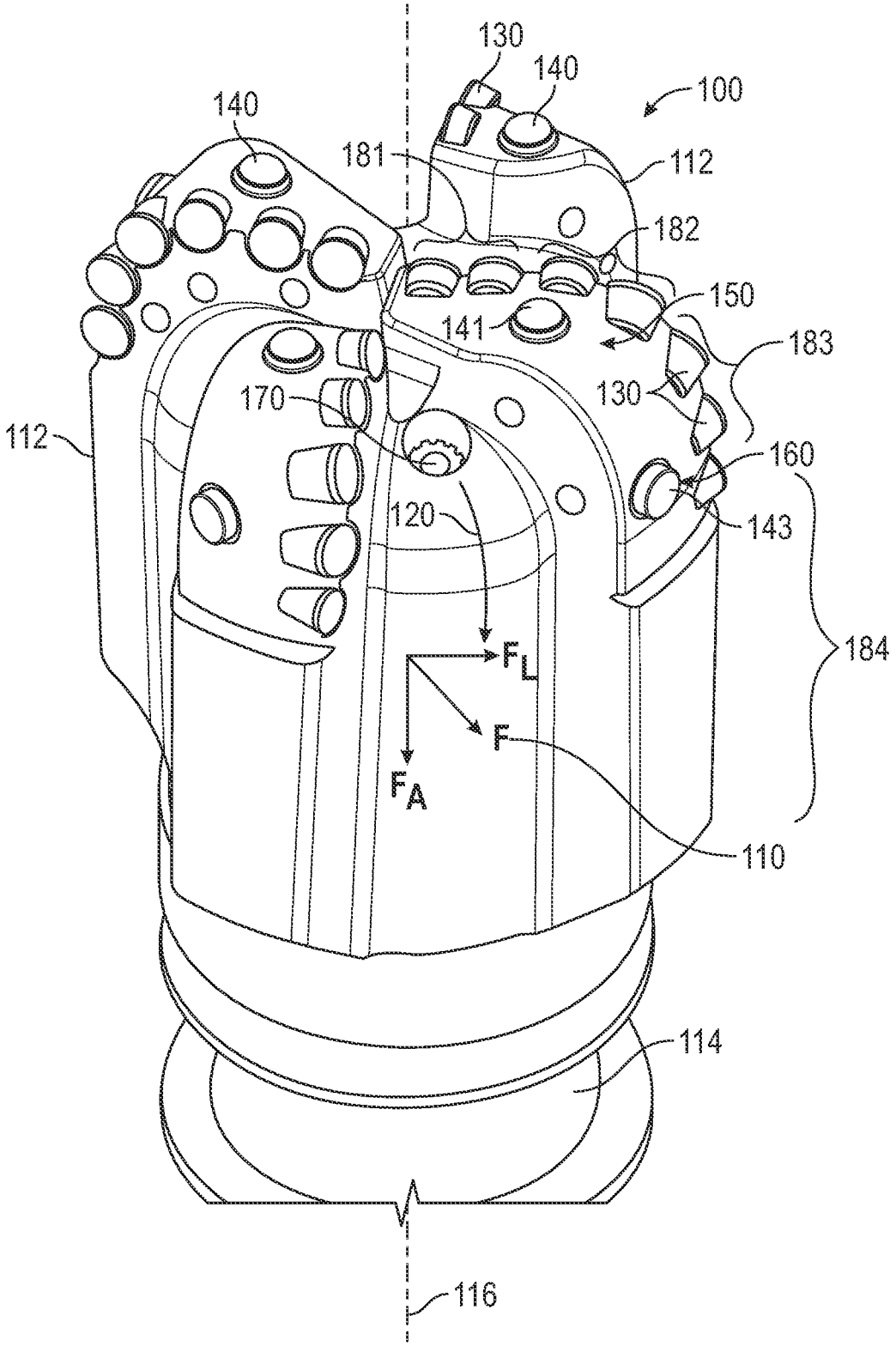
FIG. 2 is a perspective view of the drill bit according to an example configuration.

FIG. 2 is a perspective view of the drill bit 100 according to an example configuration. The drill bit 100 includes a bit body 110 with a shank 114 at one end for connecting the drill bit 100 to a drill string, e.g., via threaded connection. The bit body 110 defines a bit axis 116 about which the drill bit 100 rotates during drilling, which is generally aligned with an axis of the drill string to which the drill bit 100 would be connected. The bit body 110 includes a plurality of radially extending blades 112, which may be unitarily formed with the rest of the bit body 110, e.g., by matrix bit molding. The blades 112 are circumferentially spaced about the bit body 110, which defines respective fluid flow paths (i.e., junk slots) 120 therebetween. A plurality of nozzles 170 are disposed along an exterior of the bit body 110, such as between the blades 112. Drilling fluid (i.e., mud) circulated down the drill string exits through the nozzles 170 and along the junk slots 120. As the drilling fluid circulates, it lubricates the drill bit 100 while carrying formation cuttings and other downhole debris to surface equipment that filters the drilling fluid for further circulation.

Features of the bit body 110 and their locations may be described in terms of zones and their relative proximity to the bit axis 116. For example, each blade 112 may transition from a cone zone 181 at a leading end of the bit that traverses the bit axis 116, to a nose zone 182, a shoulder zone 183 having upper and lower shoulder regions, and then to a lateral region comprising a gauge zone 184 near a radially outermost portion of the bit body 110. Various borehole engagement members such as cutters, depth of cut control (DOCC) elements, gauge elements, rolling elements, etc. may be secured to different locations and in the various zones on the bit body 110 for directly contacting the formation while drilling. In this example, the borehole engagement members include a plurality of cutters 130 are secured at different locations along the blades 112 for cutting the formation during drilling. The borehole engagement members further include a plurality of depth of DOCC elements 140 at locations on the bit body 110 to limit a depth of cut of respective cutters 130. The DOCC elements 140 are generically illustrated as domed, smooth wear elements, which are non-cutting due to their lack of a cutting edge. However, alternative examples of other DOCC elements include a roller element, an impact arrestor, or a backup cutter.

Some of the borehole engagement members may be reciprocably secured to the bit body 110, as taught herein, allowing the engagement members to extend or retract relative to the bit body 110 during drilling. In the example of FIG. 2, each blade 112 includes an axial reciprocating assembly 150 carrying a first DOCC element (alternately referred to as the axial DOCC element) 141 and a lateral reciprocating assembly 160 carrying a second DOCC element (alternately referred to as the lateral DOCC element or gauge element) 143. The axial reciprocating assembly 150 is oriented so that its DOCC 141 receives primarily axial force components (with respect to the bit axis 116) while drilling, while the lateral reciprocating assembly 150 is oriented so its DOCC 143 receives primarily lateral force components (with respect to the bit axis 116) while drilling. The respective DOCC elements 141, 143 are mounted on carriers that are reciprocably mounted in bit body cavities and in direct sliding engagement with each other inside the bit body such that the exposure of one DOCC element 140 varies inversely with the exposure of the other DOCC element 140 on that blade 112. This mechanism is further detailed in subsequent figures.

During drilling, the drill bit 100 may encounter a variety of force components. A force vector "F" on the drill bit (e.g., a reaction force from the borehole) may be resolved into axial and lateral force components "$F_A$" and $F_L$" with respect to the bit axis 116. For example, when drilling a straight section of a borehole, the drill bit 100 encounters a large axial force component $F_A$ as a result of weight on bit (WOB). Then, as the drill bit transitions from a straight section to a deviated section, an average WOB is reduced, whereby a lateral force component $F_L$ on the drill bit 100 increases relative to the axial force component $F_A$. The exposure of the two DOCC elements 141, 143 may vary in relation to the balance of these axial and lateral forces. For example, when drilling a straight section, the DOCC element 141 on the axial reciprocating assembly 150 may be urged inwardly due to the relatively high WOB, decreasing its exposure and increasing the depth of cut of adjacent cutters 130. This may result in more aggressive cutting in the axial direction. Conversely, when drilling a curved section, the increased lateral forces relative to the axial forces (e.g., due to a reduced WOB) may urge the DOCC 143 on the lateral reciprocating assembly 160 inwardly, decreasing its exposure and increasing the corresponding depth of cut of nearby cutters 130. This may result in more aggressive lateral cutting, such as to increase a dog leg bend.

Figure 3:
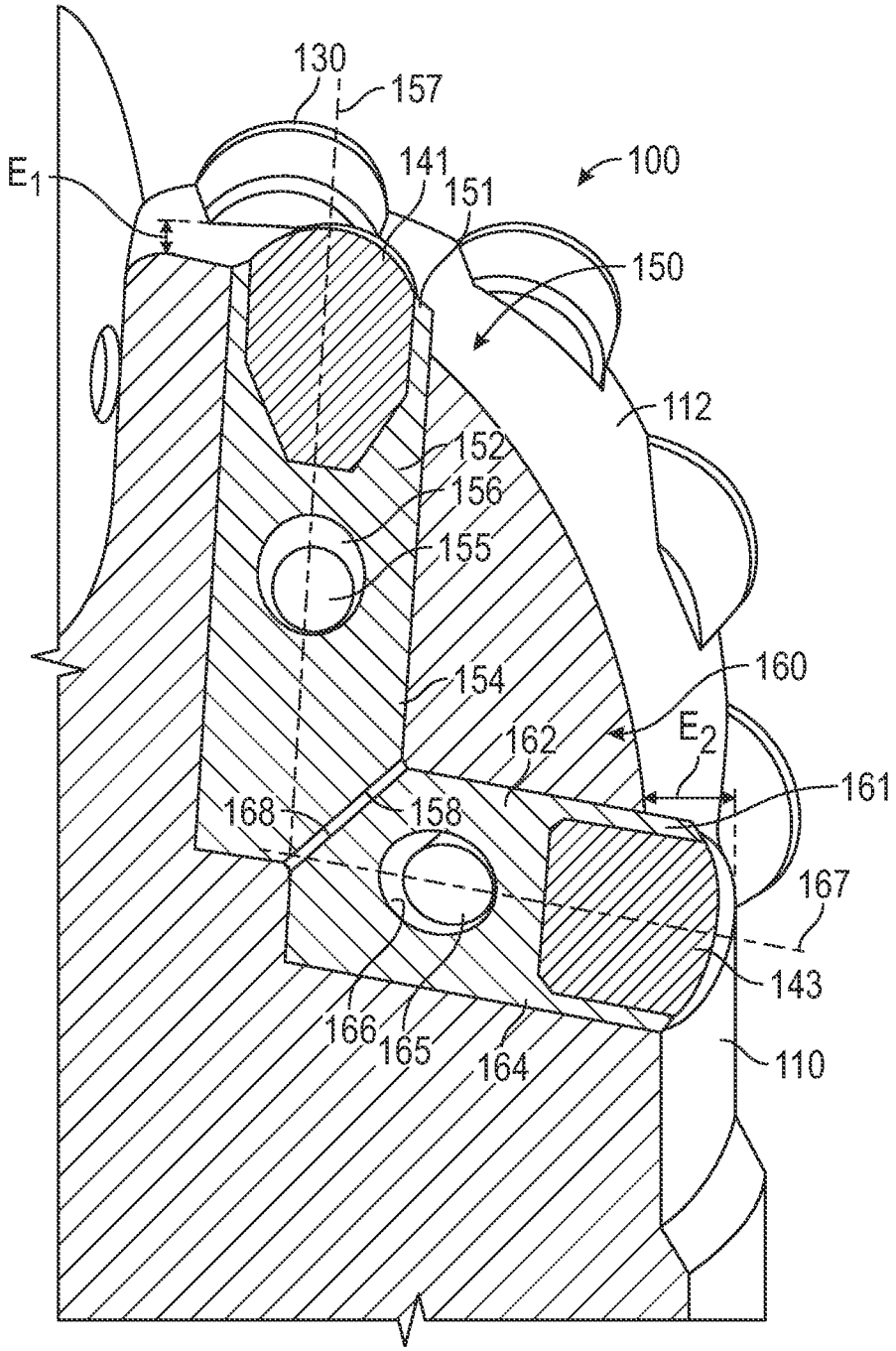
FIG. 3 is a sectional view of a drill bit blade detailing an example of axial and lateral reciprocating assemblies.

FIG. 3 is a sectional view of one of the blades 112 further detailing the axial reciprocating assembly 150 and lateral reciprocating assembly 160 according to a first example configuration. The axial reciprocating assembly 150 includes a first cavity 152 defined in the bit body 110 and a first carrier 154 moveably disposed (reciprocable) in the first cavity 152 to allow varying an exposure of a borehole engagement member secured thereto. The carrier 154 and cavity 152 may be similar in some respects to a piston and cylinder arrangement in that the cavity 152 constrains the carrier 154 to axial reciprocation. A sealing member between the carrier 154 and cavity 152, such as an O-ring, is optional but not required. The carrier 154 may be secured within the cavity 152 in any suitable way. By way of example, this configuration uses a pin 155 that passes transversely (i.e., a transverse pin) through the first carrier 154 into the bit body 110. The pin 155 and slot 156 are sized (e.g., slot 156 wider than pin 155) to allow reciprocation of the first carrier 154 along a first carrier axis 157. An alternative example for securing a carrier could be to have an annular rib received by a corresponding annular groove at an interface between the carrier and its cavity.

A borehole engagement member may be secured to an outer end 151 of the first carrier 154. The borehole engagement member in this example comprises the DOCC element 141. However, alternate examples of a borehole engagement member that could be secured to an outer end 151 of a carrier include, e.g., a roller element, an impact arrestor, or a backup cutter. An exposure $E_1$ of the DOCC element 141 is varied by reciprocation of the first carrier 154 in the cavity 152. Varying the exposure $E_1$ of the DOCC element 141 changes the depth of cut control provided to a corresponding cutter 130.

The lateral reciprocating assembly 160 is similar in some respects to the axial reciprocating assembly 150. The lateral reciprocating assembly 160 includes a second cavity 162 defined in the bit body 110 and a second carrier 164 moveably disposed in the second cavity 162 to allow varying an exposure of a borehole engagement member secured thereto. The second carrier 164 is secured within the respective second cavity 162 with a pin 165 passing transversely (i.e., a transverse pin) through the second carrier 164 into the bit body 110. The pin 165 passes through a slot 166 in the second carrier 164. The pin 165 and slot 166 are sized to allow reciprocation of the second carrier 164 along a second carrier axis 167, while still securing the second carrier 164 within the second cavity 162. The borehole engagement member in this example comprises the DOCC element 143 secured to an outer end 161 of the second carrier 164, but again, another type of borehole engagement member could be used here as well. An exposure $E_2$ of the DOCC element 143 is varied by reciprocation of the second carrier 164 in the second cavity 162. Varying the exposure $E_2$ of the DOCC element 143 changes the depth of cut control provided to a corresponding cutter 130. The exposure $E_2$ of the DOCC element 143 varies with the exposure $E_1$ of the DOCC element 141.

The first carrier axis 157 is oriented primarily toward an axial direction of the drill bit, although not necessarily parallel to the bit axis, such that it receives primarily axial force components. The second carrier axis 167 is oriented more in a lateral direction of the drill bit, although not necessarily perpendicular to the bit axis, so that it receives primarily lateral force components. Due to their respective orientations, the first DOCC element 141 will be more responsive to an axial force component (e.g., FIG. 2 $F_A$) than to lateral forces (e.g., FIG. 2 $F_B$), and conversely, the second DOCC element 143 will be more responsive to lateral forces than to axial forces. In some embodiments, the first and second carrier axis 157, 167 are substantially perpendicular to one another. However, the first and second carrier axis 157, 167 could deviate from perpendicular to some extent, such as by orienting the carriers within thirty degrees of perpendicular to one another.

The first and second carriers 154, 164 are slidably engaged inside the bit body 110 so that their exposures are inversely variable. In particular, a contact surface 158 defined by an inner end of the first carrier 154 is in direct sliding engagement with a second contact surface 168 defined by an inner end of the second carrier 164. At least one of the contact surfaces 158, 168—in this case, the contact surface 158 on the first carrier 154—is a ramped surface, such that the exposure of the first DOCC element 141 varies inversely with the exposure of the second DOCC element 143. The other contact surface 168 rides along the contact surface 158 as one carrier retracts and the other extends. In some configurations, both contact surfaces 158, 168 may be planar and lie flat against each other. However, the contact surfaces are not required to be flat. By way of example, only one contact surface 158 is flat/planar in FIG. 3, while the other contact surface 168 is rounded and rides against the planar contact surface 158. Embodiments may even be constructed wherein neither contact surface is planar. For example, in another configuration, the ramped contact surface 158 could be formed as a convex surface with a large radius that the other contact surface 168 rides along.

The carriers 154, 164 may be formed of a hard, wear-resistant material, such as a carbide, of which tungsten carbide (WC) is a preferred variant. A coating may be applied to one or both cavities 152, 162 and to one or both carriers 154, 164, such as to generally increase wear resistance and/or reduce friction. A coating could also be selectively applied to selectively modify the friction and corresponding resistance to movement of one carrier relative to the other to tune the dynamics of the system. For example a coating could be applied to just one carrier or its cavity, or different coatings may be used on different surfaces, to adjust the respective friction coefficients between each carrier and its cavity.

Figure 4:
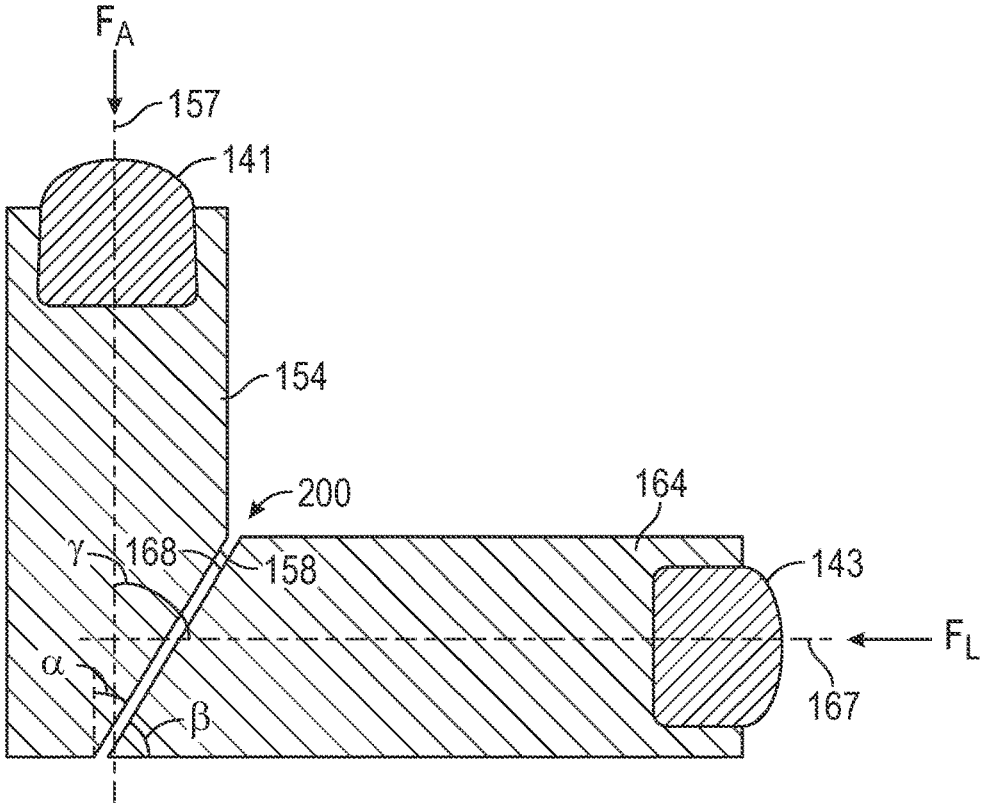
FIG. 4 is a sectional side view of the carriers for discussing a sliding interface.

FIG. 4 is a sectional side view of the carriers 154, 164 detailing geometry of a sliding interface 200 between the first and second contact surfaces 158, 168. In this example, both contact surfaces 158, 168 are depicted as being planar, ramped surfaces that are parallel and thereby remain in flat engagement with each other as the first and second carriers 154, 164 reciprocate within their respective cavities. Although not required, this arrangement of parallel, planar contact surfaces may promote uniform wear and longevity at the sliding interface 200. The carriers may be formed of a hard, wear-resistant material, such as a carbide, of which tungsten carbide (WC) is a preferred variant. However, other hard, wear-resistant materials may be used in the alternative or in combination with a carbide, such as a polycrystalline diamond table or a diamond or other hard coating that defines one or both contact surfaces 158, 168.

The carrier axis 157, 167 are depicted as being perpendicular to one another, i.e., an angle gamma ("$\gamma$") of ninety degrees, but $\gamma$ may deviate from perpendicular by up to thirty degrees, i.e., a range of between eighty to one-hundred degrees, in some embodiments. The first contact surface 158 has a slope angle alpha ("$\alpha$") with respect to its carrier axis 157. The second contact surface 168 has a slope angle beta ("$\beta$") with respect to its carrier axis 167. The slope angles may be equal in some embodiments. For example, in a case where the carrier axis 157, 167 are perpendicular ($\gamma$=ninety degrees), each slope angle may be forty-five degrees.

The slope angles $\alpha$, $\beta$ are not required to be equal, however. In some examples each slope angle may be in a range of between forty and fifty degrees with respect to the carrier axis of the respective carrier. In other examples, each slope angle may be in a range of between thirty and sixty degrees with respect to the carrier axis of the respective carrier. In still other examples, each slope angle may be in a range of between twenty and seventy degrees with respect to a carrier axis of the respective carrier. For instance, the carriers may be perpendicular, with one slope angle as small as thirty degrees and the other slope angle as large as sixty degrees.

In the example of perpendicular (ninety-degree) carriers and equal (forty-five degree) slope angles, equal axial and lateral force components $F_A$, $F_L$ applied to the respective carriers 154, 164 should generally balance. In that case, when $F_A>F_L$, the axial DOCC element 141 would tend to move inwardly (decreased exposure) and the lateral DOCC element 143 would tend to move outwardly (increased exposure). Conversely, when $F_A<F_L$, the axial DOCC element 141 would move outwardly (increased exposure) and the lateral DOCC element 143 would move inwardly (decreased exposure).

The slope angles are another parameter that may be adjusted to tune the system. As one slope angle decreases relative to the other slope angle, the leverage of the former carrier may increase relative to the latter carrier. For example, in the case of slope angle $\alpha$ being less than slope angle $\beta$, the axial carrier 154 has more leverage, so that equal axial and lateral force components $F_A$, $F_L$ should result in biasing the axial DOCC element 141 inwardly and the lateral DOCC element 143 outwardly.

Figure 5:
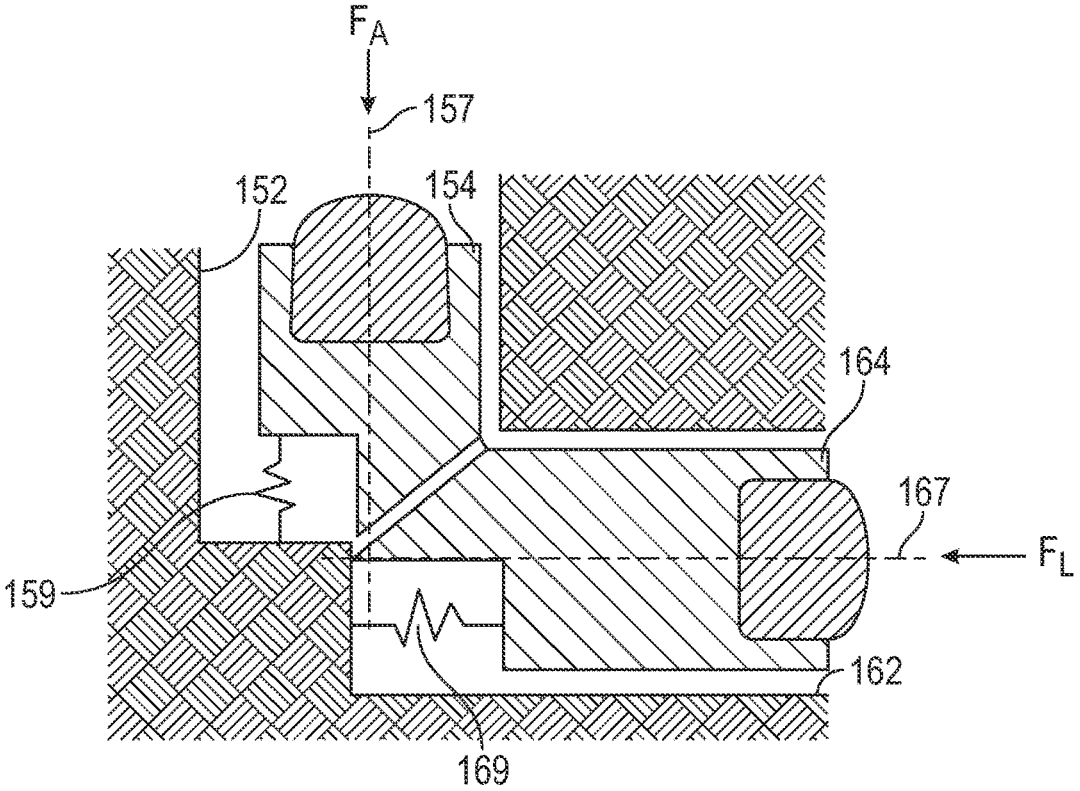
FIG. 5 is a sectional side view of the carriers incorporating biasing members.

FIG. 5 is a sectional side view of the carriers 154, 164 incorporating the use of biasing members, alternately referred to in simple terms as springs and/or dampers schematically indicated at 159, 169. Non-limiting examples of spring/damper combinations include steel springs with hydraulic dampers or an elastomeric material formulated to provide both spring-like biasing and damping. The springs and/or dampers 159, 169 may be positioned anywhere at the interface between the respective carrier 154, 164 and cavities to bias the carriers 154, 164 in axial directions corresponding to their carrier axis 157, 167. In this example, the springs and/or dampers 159, 169 are schematically shown as being positioned between an inner end of each carrier and a floor of its respective cavity 152, 162. In the absence of axial and lateral forces $F_A$, $F_L$ on the carriers 154, 164, the springs and/or dampers 159, 169 may bias the carriers 154, 164 to a neutral position.

The springs and/or dampers 159 may have relatively high spring constants so that an appreciable amount of force must be applied to the borehole engagement members, and/or an appreciable force differential must exist therebetween, before the carriers 154, 164 move significantly away from their neutral position. The springs and/or dampers 159, 169 therefore help avoid a scenario whereby a relatively small force differential ($F_A$-$F_L$) might cause one carrier or the other to easily bottom out on the floor of its respective cavity. The springs are also another parameter that may be varied to tune the dynamics of the system. For example, the spring and/or dampers 159 at the axial reciprocating assembly 150 may be stiffer than the spring and/or dampers 169 at the lateral reciprocating assembly 160 if it is expected that maximum axial forces are significantly higher than lateral forces while drilling.

Figure 6:
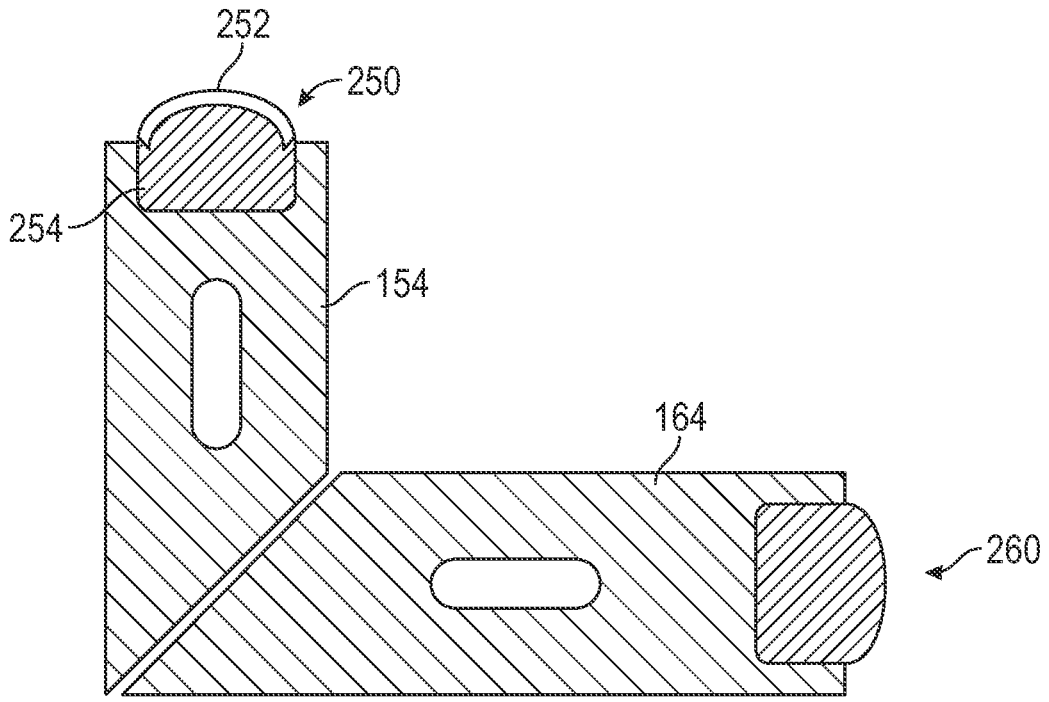
FIG. 6 is a sectional side view of the carriers with further examples of axial and lateral borehole engagement members.

FIG. 6 is a sectional side view of the carriers 154, 164 further detailing examples of axial and lateral borehole engagement members 250, 260. Both of the borehole engagement members 250, 260 are domed, non-cutting elements that are designed to engage the borehole without appreciable cutting, i.e., without a defined cutting edge like on a cutter. The axial engagement member 250 may be used in the cone or nose region of a drill bit, while the lateral engagement member 260 may be used in the lower shoulder or gauge region of the drill bit. The axial engagement member 250 in this example has a superhard (e.g., diamond) material 252 on a substrate 254, wherein the diamond material or other superhard material is exposed for contact with a formation while drilling. The superhard material 252 may be a polycrystalline diamond (PCD) coating on the substrate 254. The axial borehole engagement member 250 may alternatively be a polycrystalline diamond compact (PDC) formed in a high-temperature, high-pressure press cycle that simultaneously forms diamond-diamond bonds in a diamond table while bonding that diamond table to a substrate. The axial borehole engagement member 260 is a unitary wear element that may comprise substantially carbide substrate, without necessarily including a coating or diamond table. This arrangement may be suitable for cases where lateral forces and wear are expected to be significantly less than axial forces and wear.

Figure 7:
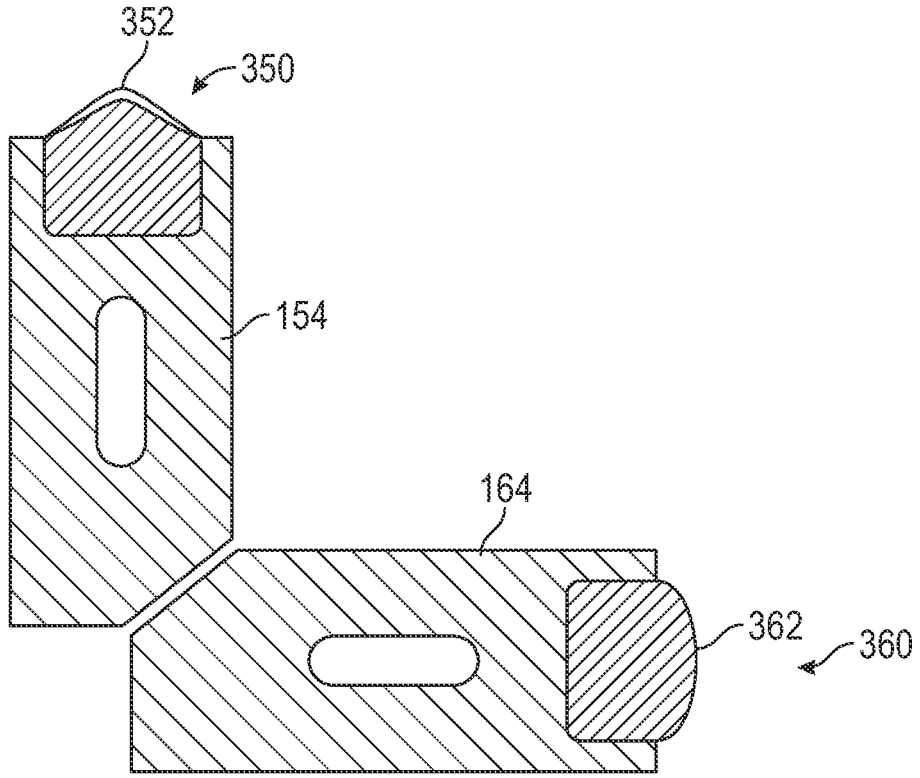
FIG. 7 is a sectional side view of the carriers detailing another example of axial and lateral borehole engagement members.

FIG. 7 is a sectional side view of the carriers 154, 164 detailing another example of axial and lateral borehole engagement members 350, 360. The axial borehole engagement member 350 is a relatively pointed borehole engagement member that results in relatively high contact stresses at its tip 352 due to a smaller contact area with the borehole. By contrast, the lateral borehole engagement member 360 has a more blunt, domed profile 362 that has comparatively higher contact area with the borehole and correspondingly lower contact stresses. The shape of the axial borehole engagement member 350 results in a more aggressive engagement with the borehole, while the broader shape of the lateral borehole engagement member 360 results in a less aggressive engagement with the borehole.

The foregoing example configurations are non-limiting. Thus, any number of alternate configurations may be formed within the scope of this disclosure using different combinations of features. The list of borehole engagement member features that may be varied to construct different embodiments may include any suitable combination, for example, of the disclosed type and shape of borehole engagement members, their base materials, coatings, or superhard tables secured thereto, their geometry, and their breadth. The geometry of the sliding interface between carriers may also be varied, such as the slope angles of the contact surfaces, the angle of the carrier axis, and the orientations of the carriers with respect to the bit may also be varied in combination with any of the foregoing features.

Methods also follow from this disclosure, such as various methods of manufacturing a drill bit and methods of drilling using a drill bit. In one or more embodiments, a drilling method may comprise forming a borehole by rotating a drill bit about a bit axis while engaging a formation with a plurality of fixed cutters on the drill bit. The method may also include engaging the borehole with a first engagement member on a first carrier that is reciprocably received in a first cavity defined in the drill bit in response to an axial force component, as disclosed herein. The borehole may be simultaneously engaged with a second engagement member on a second carrier reciprocably received in a second cavity of the drill bit in response to a lateral force component. A first contact surface on the first carrier may be slidable engaged with a second contact surface on the second carrier inside the drill bit, with at least one of the contact surfaces being ramped, so that an exposure of the first engagement member and the second engagement member may vary in response to a force differential between axial and lateral force components. The apparatus, methods, systems, tools, and other constructs of this disclosure may include any of the various features disclosed herein, including one or more of the following examples.

Example 1. A drill bit, comprising: a bit body having a bit axis; a plurality of fixed cutters secured to the bit body; an axial reciprocating assembly comprising a first cavity defined in the bit body, a first carrier reciprocable in the first cavity, and a first borehole engagement member on an outer end of the first carrier; a lateral reciprocating assembly comprising a second cavity defined in the bit body intersecting with the first cavity, a second carrier reciprocable in the second cavity, and a second borehole engagement member on an outer end of the second carrier; and a sliding interface comprising a first contact surface defined by the first carrier and a second contact surface defined by the second carrier in direct sliding engagement with the first contact surface inside the bit body, such that an exposure of the first borehole engagement member varies with an exposure of the second borehole engagement member.

Example 2. The drill bit of Example 1, wherein at least one of the first and second contact surfaces comprises a ramped surface at an angle of between twenty and seventy degrees with respect to a carrier axis of the respective carrier.

Example 3. The drill bit of any of Examples 1-2, wherein at least one of the first and second contact surfaces comprises a ramped surface at an angle of between thirty and sixty degrees with respect to a carrier axis of the respective carrier.

Example 4. The drill bit of any of Examples 1-3, wherein the first and second contact surfaces both comprise ramped surfaces that remains in flat engagement with each other as the first and second carriers reciprocate within their respective cavities.

Example 5. The drill bit of any of Examples 1-4, wherein the first and second carriers each define a respective carrier axis that are oriented within thirty degrees of perpendicular to one another.

Example 6. The drill bit of any of Examples 1-5, wherein one or both of the first and second borehole engagement members comprises a polycrystalline diamond secured to a carbide substrate, wherein the carbide substrate is secured to the carrier and the polycrystalline diamond is exposed for contact with a formation.

Example 7. The drill bit of any of any of Examples 1-6, wherein one or both of the first and second borehole engagement members comprises a non-cutting depth of cut control (DOCC) element positioned on the bit body to limit a depth of cut of a respective one of the fixed cutters.

Example 8. The drill bit of any of any of Examples 1-7, wherein the first borehole engagement member on the axial reciprocating assembly is in a cone, nose, or upper shoulder of a blade extending from the bit body, and wherein the second borehole engagement member on the lateral reciprocating assembly is in a gauge region or lower shoulder of the bit body.

Example 9. The drill bit of any of Examples 1-8, wherein the second borehole engagement member is wider and/or more blunt than the first borehole engagement member.

Example 10. The drill bit of any of Examples 1-9, further comprising: a biasing member in the first cavity to bias the first carrier axially; and a biasing member in the second cavity to bias the second carrier axially.

Example 11. The drill bit of any of Examples 1-10, wherein each carrier is secured within the respective cavity with a pin passing transversely through the carrier into the bit body.

Example 12. The drill bit of any of Examples 1-11, further comprising a coating applied to modify a coefficient of friction between the carrier and the cavity of the axial reciprocating assembly or between the carrier and the cavity of the lateral reciprocating assembly.

Example 13. A drill bit, comprising: a bit body having a bit axis, the bit body transitioning from a leading end that traverses the bit axis to a lateral region extending to a radially outermost part of the bit body; a plurality of fixed cutters secured to the bit body; an axial reciprocating assembly at the leading end of the bit body, comprising a first cavity defined in a first carrier reciprocable in the first cavity to adjust an exposure of a first borehole engagement member secured to the first carrier, and a first ramped surface defined by an inner end of the carrier; and a lateral reciprocating assembly at the lateral region of the bit body, comprising a second cavity intersecting with the first cavity, a second carrier reciprocable in the second cavity to adjust an exposure of a second borehole engagement member secured to the second carrier, and a second ramped surface defined by an inner end of the second carrier; and wherein the first and second ramped surfaces are in direct sliding engagement inside the bit body such that the exposure of the first borehole engagement member varies with the exposure of the second borehole engagement member.

Example 14. The drill bit of Example 13, wherein the leading end of the bit body comprises a cone, nose, or upper shoulder of one or more blades, and wherein the lateral region comprises a gauge region and lower shoulder of the bit body.

Example 15. The drill bit of any of Examples 13-14, wherein ramped surfaces are at an angle of between twenty and seventy degrees with respect to a carrier axis of the respective carrier.

Example 16. The drill bit of any of Examples 13-15, wherein the first and second carriers each define a respective carrier axis that are oriented within thirty degrees of perpendicular to one another.

Example 17. A drilling method, comprising: forming drilling a borehole by rotating a drill bit about a bit axis while engaging a formation with a plurality of fixed cutters on the drill bit; engaging the borehole with a first engagement member on a first carrier reciprocably received in a first cavity defined in the drill bit in response to an axial force component; engaging the borehole with a second engagement member on a second carrier reciprocably received in a second cavity of the drill bit in response to a lateral force component; slidably engaging a first contact surface on the first carrier with a second contact surface on the second carrier inside the drill bit, wherein at least one of the first and second contact surfaces is ramped; and adjusting a respective exposure of the first engagement member and the second engagement member responsive to a force differential between axial a force component on the first engagement member and lateral a force components on the second engagement member while sliding the first and second contact surfaces during reciprocation of the first and second carriers.

Example 18. The drilling method of Example 17, wherein adjusting the respective exposure of the first and second engagement members comprises limiting a depth of cut of a respective one of the fixed cutters.

Example 19. The drilling method of any of Examples 17-18, further comprising using a biasing member in the first cavity to axially bias the first carrier outwardly and using a biasing member in the second cavity to axially bias the second carrier outwardly, so that the bias on the first carrier in combination with the lateral force component on the second carrier combine to urge the first carrier outwardly and the bias on the second carrier in combination with the axial force component on the first carrier combine to urge the second carrier outwardly.

Example 20. The drilling method of any of Examples 17-19, further comprising: drilling the borehole along a straight section at a weight on bit (WOB) whereby the force differential decreases exposure of the first engagement member and increases exposure of the second engagement member when drilling the straight section; and drilling the borehole along a curved deviated section, whereby a reduction in the WOB from transitioning from the straight section to the deviated section drives the force differential to increases the exposure of the first engagement member when drilling the curved section.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

What is claimed is:

1. A drill bit, comprising:

a bit body having a bit axis;

a plurality of cutters secured to the bit body;

an axial reciprocating assembly comprising a first cavity defined in the bit body, a first carrier reciprocable in the first cavity, and a first borehole engagement member on an outer end of the first carrier;

a lateral reciprocating assembly comprising a second cavity defined in the bit body intersecting with the first cavity, a second carrier reciprocable in the second cavity, and a second borehole engagement member on an outer end of the second carrier; and a sliding interface comprising a first contact surface defined by the first carrier and a second contact surface defined by the second carrier in direct sliding engagement with the first contact surface inside the bit body, such that an exposure of the first borehole engagement member varies with an exposure of the second borehole engagement member.

2. The drill bit of claim 1, wherein at least one of the first and second contact surfaces comprises a ramped surface at an angle of between twenty and seventy degrees with respect to a carrier axis of the respective carrier.

3. The drill bit of claim 1, wherein at least one of the first and second contact surfaces comprises a ramped surface at an angle of between thirty and sixty degrees with respect to a carrier axis of the respective carrier.

4. The drill bit of claim 1, wherein the first and second contact surfaces both comprise ramped surfaces that remain in flat engagement with each other as the first and second carriers reciprocate within their respective cavities.

5. The drill bit of claim 1, wherein the first and second carriers each define a respective carrier axis that are oriented within thirty degrees of perpendicular to one another.

6. The drill bit of claim 1, wherein one or both of the first and second borehole engagement members comprises a polycrystalline diamond secured to a carbide substrate, wherein the carbide substrate is secured to the second carrier, and wherein the polycrystalline diamond is exposed for contact with a formation.

7. The drill bit of claim 1, wherein one or both of the first and second borehole engagement members comprises a non-cutting depth of cut control (DOCC) element positioned on the bit body to limit a depth of cut of a respective one of the cutters.

8. The drill bit of claim 1, wherein the first borehole engagement member on the axial reciprocating assembly is in a cone, nose, or upper shoulder of a blade extending from the bit body, and wherein the second borehole engagement member on the lateral reciprocating assembly is in a gauge region or lower shoulder of the bit body.

9. The drill bit of claim 8, wherein the second borehole engagement member is wider and/or more blunt than the first borehole engagement member.

10. The drill bit of claim 1, further comprising:

a biasing member or a damper in one or both of the first cavity and the second cavity to bias or dampen the first carrier or second carrier axially.

11. The drill bit of claim 1, wherein each carrier is secured within the respective cavity with a pin passing transversely through the carrier into the bit body.

12. The drill bit of claim 1, further comprising a coating applied to modify a coefficient of friction between the first carrier and the cavity of the axial reciprocating assembly or between the second carrier and the cavity of the lateral reciprocating assembly.

13. A drill bit, comprising:

a bit body having a bit axis, the bit body transitioning from a leading end that traverses the bit axis to a lateral region extending to a radially outermost part of the bit body;

a plurality of fixed cutters secured to the bit body;

an axial reciprocating assembly at the leading end of the bit body, comprising a first cavity defined by a first carrier reciprocable in the first cavity to adjust an exposure of a first borehole engagement member secured to the first carrier, and a first ramped surface defined by an inner end of the first carrier; and a lateral reciprocating assembly at the lateral region of the bit body, comprising a second cavity intersecting with the first cavity, a second carrier reciprocable in the second cavity to adjust an exposure of a second borehole engagement member secured to the second carrier, and a second ramped surface defined by an inner end of the second carrier; and wherein the first and second ramped surfaces are in direct sliding engagement with each other inside the bit body such that the exposure of the first borehole engagement member varies with the exposure of the second borehole engagement member.

14. The drill bit of claim 13, wherein the leading end of the bit body comprises a cone, nose, or upper shoulder of one or more blades, and wherein the lateral region comprises a gauge region and lower shoulder of the bit body.

15. The drill bit of claim 13, wherein the first and second ramped surfaces are at an angle of between thirty and sixty degrees with respect to a carrier axis of the respective carrier.

16. The drill bit of claim 13, wherein the first and second carriers each define a respective carrier axis that are oriented within thirty degrees of perpendicular to one another.

17. A drilling method, comprising:

drilling a borehole by rotating a drill bit about a bit axis while engaging a formation with a plurality of cutters on the drill bit;

engaging the borehole with a first engagement member on a first carrier reciprocably received in a first cavity defined in the drill bit;

engaging the borehole with a second engagement member on a second carrier reciprocably received in a second cavity of the drill bit;

slidably engaging a first contact surface on the first carrier with a second contact surface on the second carrier inside the drill bit, wherein at least one of the first and second contact surfaces is ramped; and adjusting a respective exposure of the first engagement member and the second engagement member responsive to a force differential between a force component on the first engagement member and a force component on the second engagement member while sliding the first and second contact surfaces during reciprocation of the first and second carriers.

18. The drilling method of claim 17, wherein adjusting the respective exposure of the first and second engagement members comprises limiting a depth of cut of a respective one of the cutters.

19. The drilling method of claim 17, further comprising using a biasing member in the first cavity to axially bias the first carrier and a biasing member in the second cavity to axially bias the second carrier.

20. The drilling method of claim 17, further comprising:

drilling the borehole along a straight section at a weight on bit (WOB) whereby the force differential decreases exposure of the first engagement member and increases exposure of the second engagement member when drilling the straight section; and drilling the borehole along a deviated section, whereby a reduction in the WOB from transitioning from the straight section to the deviated section adjusts the force differential to increase the exposure of the first engagement member.

* * * * *